US010383451B2

(12) United States Patent
Miller

(10) Patent No.: US 10,383,451 B2
(45) **Date of Patent: *Aug. 20, 2019**

(54) PORTABLE HEAD SUPPORT

(71) Applicant: Andrew Miller, Atlanta, GA (US)

(72) Inventor: Andrew Miller, Atlanta, GA (US)

( * ) Notice: Subject to any disclaimer, the term of this patent is extended or adjusted under 35 U.S.C. 154(b) by 195 days.

This patent is subject to a terminal disclaimer.

(21) Appl. No.: 15/656,455

(22) Filed: Jul. 21, 2017

(65) Prior Publication Data

US 2017/0340125 A1 Nov. 30, 2017

Related U.S. Application Data

(63) Continuation-in-part of application No. 15/078,704, filed on Mar. 23, 2016, now Pat. No. 9,770,113.

(51) Int. Cl.
*A47C 16/00* (2006.01)
*A47C 7/38* (2006.01)

(52) U.S. Cl.
CPC ..... *A47C 16/00* (2013.01); *A47C 7/383* (2013.01)

(58) Field of Classification Search
CPC ..... A47C 16/00; A47C 7/383
USPC ..... 297/397; 5/640, 643
See application file for complete search history.

(56) References Cited

U.S. PATENT DOCUMENTS 8,584,283 B2 * 11/2013 Mabry ..... A47C 16/00 5/632
8,985,693 B2 * 3/2015 Purpura ..... A45F 4/06 297/397 X
9,283,878 B2 * 3/2016 Zaouk ..... B60N 2/4879

* cited by examiner

*Primary Examiner* — Anthony D Barfield
(74) *Attorney, Agent, or Firm* — Hill, Kertscher & Wharton, LLP; Gregory T. Ourada

(57) ABSTRACT

The invention is directed to a portable head support designed to fit in the interior of a carry-on article carried by a passenger. The device provides head support for those who prefer sleeping in a face-down position and comprises a base and a head support connected along at least one of their abutting edges by a mechanism which permits the angle between the base and head support to be adjusted by the user.

12 Claims, 7 Drawing Sheets

PORTABLE HEAD SUPPORT

CROSS-REFERENCE TO RELATED APPLICATIONS

This application is a continuation-in-part of application Ser. No. 15/078,704 filed Mar. 23, 2016, now U.S. Pat. No. 9,770,113, which is incorporated herein in its entirety.

BACKGROUND OF THE INVENTION

People who travel, especially those who travel by plane, train, or bus, are faced with the problem of trying to comfortably rest in waiting areas and on board a vehicle. Some airports, train stations, and bus terminals may provide lounges where travelers can lie down to sleep. Travelers who fly first class, or who can afford sleeper cabins on board a train may be provided with seats that comfortably recline, or an actual bed, but such amenities are not available to the vast majority of travelers who are instead confined to a sitting position. For these persons, sleep deprivation is one of the most unpleasant aspects of travel. Certain solutions such as neck pillows alleviate the problem somewhat by providing head support. However, for some travelers who prefer to sleep in the prone position, i.e. face-down, or on their side, neck pillows do not provide an optimal solution. Sleeping with one's head on a folded-down tray table is also not an optimal solution. Clearly, a solution that provides more of a sensation of "lying down" for these travelers is very desirable.

BRIEF SUMMARY OF THE INVENTION

This invention described herein provides support for a person's head to rest or sleep on when restricted to a seated position with limited space such as on a plane, bus, train, etc. It is generally flat and designed to fit inside a backpack, laptop bag, or carry-on item which is used as part of the support platform (the backpack is placed in your lap and holds the bottom section of the portable head support). It consists of (1) a baseboard, i.e. a support panel that slides into and is held in place inside a carry-on backpack or other item of hand-carried luggage and (2) a head support. The baseboard and the head support are joined by a hinge having an adjustable range of motion allowing the head reclining angle to be easily adjusted. The invention is designed to be compact, easy-to-use, and optimizes limited space. One of the discovered advantages is that holding a backpack or other carry-on on one's lap with the arms while using the portable head support to also provides some support to the traveler's torso as well. The range of motion of the hinge is adjustable to permit different head reclining angles. In one embodiment, the head support has hook-and-loop or other detachable fasteners permitting different types of head cushions to be interchanged. Another embodiment features interchangeable head supports of differing shapes.

DETAILED DESCRIPTION OF THE INVENTION

The invention is described in preferred embodiments in the following description with reference to the Figures, in which like numbers represent the same or similar elements. Reference throughout this specification to "one embodiment", "an embodiment", or similar language means that particular feature, structure, or characteristic described in connection with the embodiment is included in at least one embodiment of the present invention. Thus, appearances of the phrases "in one embodiment", "in an embodiment", "in certain embodiments", and similar language throughout this specification may, but do not necessarily, all refer to the same embodiment. It is noted that, as used in this description, the singular forms "a", "an", and "the" include plural referents unless the context clearly dictates otherwise.

The described features, structures, or characteristics of the invention may be combined in any suitable manner in one or more embodiments. In the following description, numerous specific details are recited to provide a thorough understanding of embodiments of the invention. One skilled in the relevant art will recognize, however, that the invention may be practiced without one or more of the specific details, or with other methods, components, materials, and so forth. In other instances, well-known structures, materials, or operations are not shown or described in detail to avoid obscuring aspects of the invention.

Figure 3:
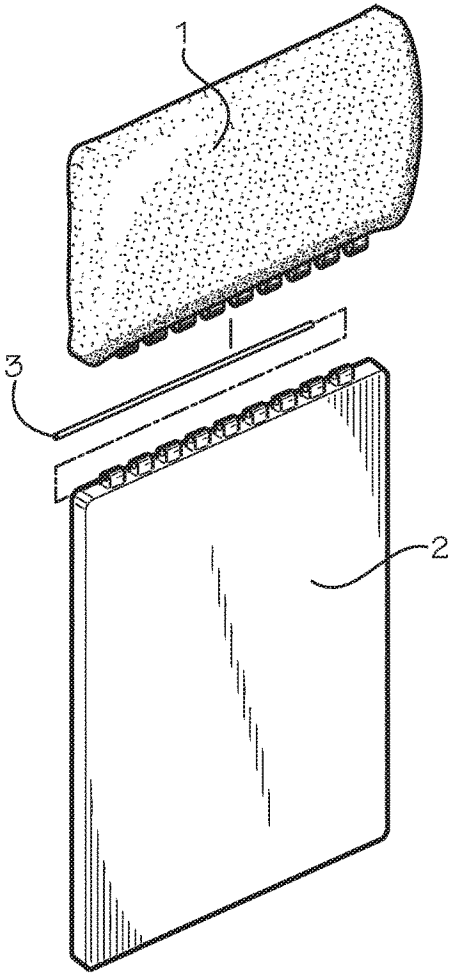
FIG. 3 shows an exploded isometric view of the components of one preferred embodiment of the invention.
Figure 2:
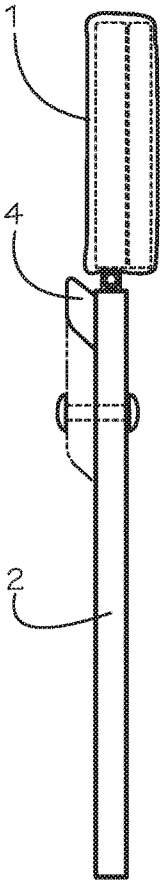
FIG. 2 shows a side view of one preferred embodiment of the invention.
Figure 1:
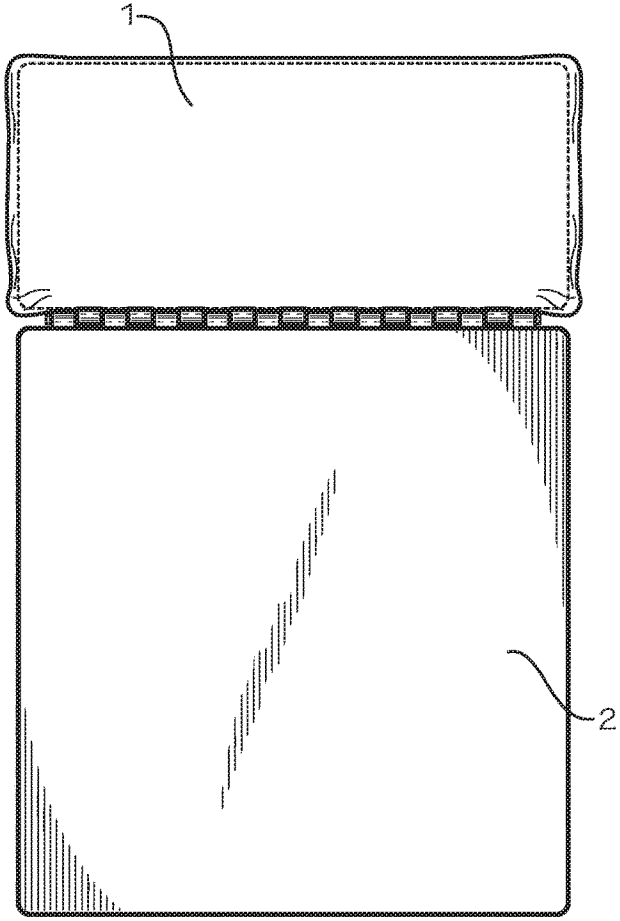
FIG. 1 shows a frontal view of one preferred embodiment of the invention.
Figure 5:
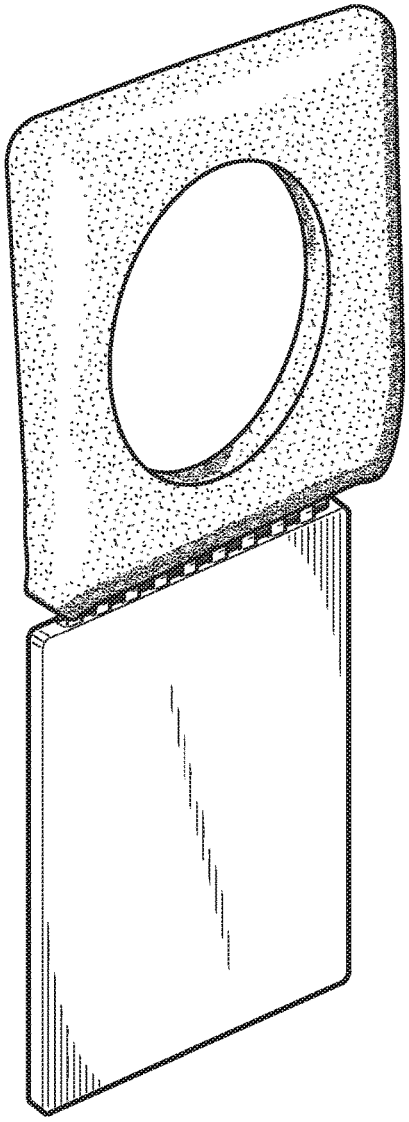
FIG. 5 shows one preferred embodiment of the invention with one alternate headrest.
Figure 6:
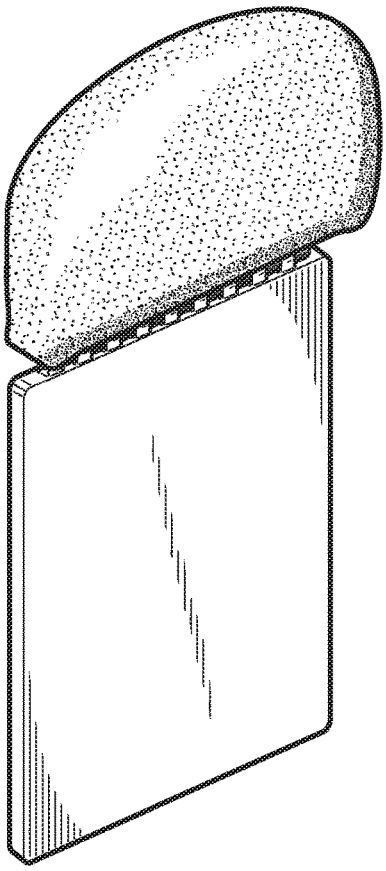
FIG. 6 shows one preferred embodiment of the invention with another alternate headrest.
Figure 8:
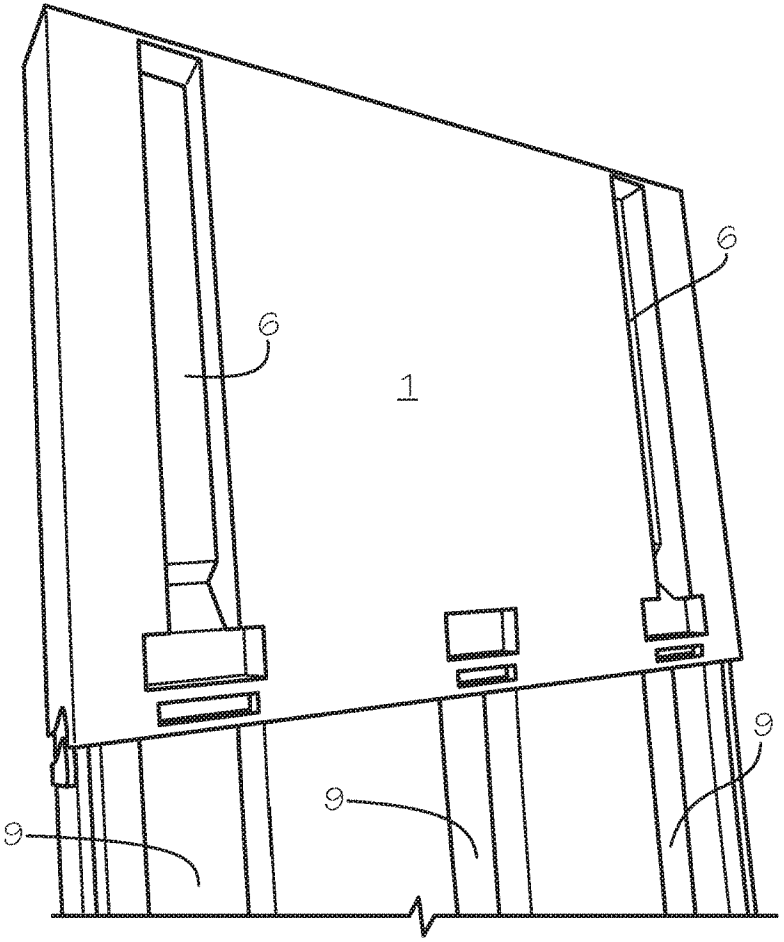
FIG. 8 is a front view of an alternate embodiment of the invention.

FIGS. 1-3 show a basic embodiment of a portable head support, comprised of a headrest 1, baseboard 2, and hinge 3. A mechanical angle stop 4 appearing in certain embodiments is also shown in FIG. 2. The headrest 1 in the most basic embodiment is made of a 0.5" thick flat piece of wood or plastic, with dimensions 6" long, 8.5" wide. Headrest 1 provides the user with a reclining platform on which to rest her head. Headrest 1 can also accommodate a variety of cushions. In certain embodiments, a variety of cushions may be interchanged by the user by using hook-and-loop or another suitable detachable fastener on one side of headrest 1 and cushion. Although headrest 1 as shown is rectangular, other shapes are possible. In one particular alternate embodiment, headrest 1 itself is able to be detached, so that different-shaped headrests such as those in FIGS. 5 and 6 can be interchanged. In the particular embodiment shown in FIGS. 1-3, where a mechanical stop is used, the headrest 1 will not be able to be folded 180 degrees so that it lies parallel to baseboard 2. In this particular embodiment, the shape of the headrest will be dictated in some cases by the shape of the interior of the carry-on item that the portable head support is intended to be used with. However, in embodiments not featuring a mechanical stop, or in embodiments having detachable cushions, where the headrest can be folded 180 degrees, the shape of the headrest will not be as important. Nevertheless, the shape of the headrest will be dictated both by the interior of the carry-on item with which the portable head support will be used, and the tastes of the particular user. For example, FIG. 5 shows a headrest 1 with a hole accommodating a user's face that allows a user to sleep "facedown", while the embodiment shown in FIG. 6 is rounded at the top in order to accommodate its use within a backpack having a rounded top.

Figure 4:
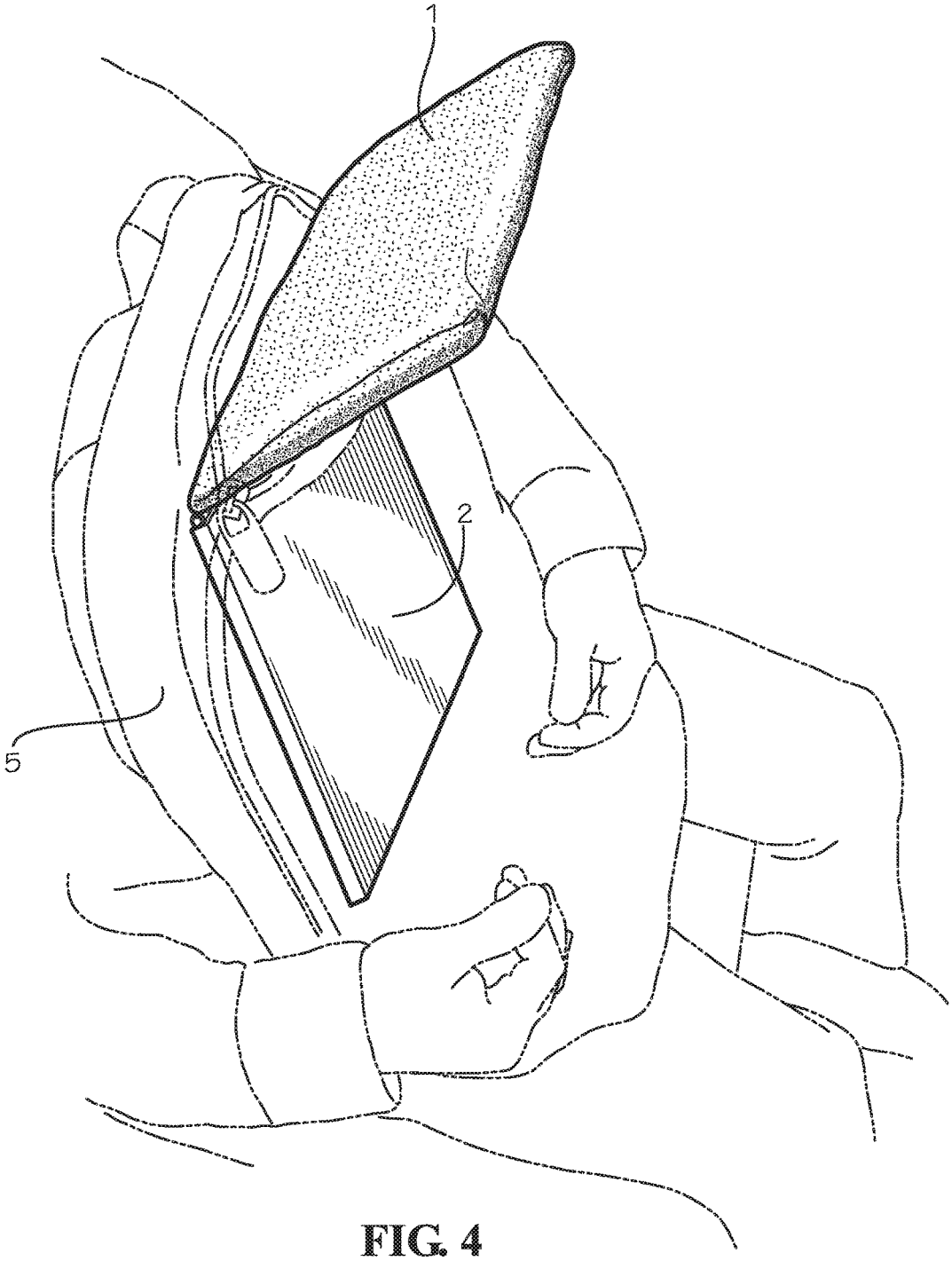
FIG. 4 shows a preferred embodiment in use with a carry-on article.

Baseboard 2 is made of a 0.375" flat piece of wood or plastic with dimensions 8.5" by 8.5"; however, the dimensions of baseboard 2 are selected according to what size carry-on item the portable head support is intended to be used with. Baseboard 2 is designed to fit inside a carry-on item such as a backpack, computer bag, or even a purse as shown in FIG. 4. In most embodiments, it is desirable that baseboard 2 be substantially flat, e.g. having a thickness that is 15-30 times (depending on the stiffness of the material used) less than the baseboard's length or width, because it is desirable that the portable head support as a whole be of minimum volume, since it is intended to be carried entirely within a carry-on item while not in use. As noted above, if baseboard 2 is defined by a length $L_b$, width $W_b$ and thickness $T_b$, then, $L_b$, is approximately equal to $W_b$ and $T_b \ll L_b$ and $W_b$.

However, it is also conceived that some embodiments of the portable head support are designed to, for example, fit down the back of a person's shirt and provide support for the head from behind. In this example, baseboard 2 might be shaped so that $W_b < L_b$, i.e. that baseboard 2 is more rectangular than square.

It is generally desirable that the texture of both sides of baseboard 2 be such that it can be slid upward and downward within a carry-on item 5 relatively easily, yet have enough friction that headrest 1 doesn't have a tendency to slide downward when in use. Baseboard 2 in most preferred embodiments is therefore flat, so that it easily fits into a cavity inside a carry-on item. For example, baseboard 2 is flat in most embodiments because it is designed to slip between items of folded clothing in a backpack or other carry-on item.

Hinge 3 in one embodiment is made of a slender metal or plastic rod that is seated in a cylindrical channel defined by adjacent channel segments emanating alternately from one side of headrest 1 and baseboard 2 as shown in FIGS. 1-3. In the embodiment shown in FIG. 2, there is a mechanical stop 4 shown that limits the angular movement of headrest 1 relative to baseboard 2. In certain other embodiments, hinges that are known to the art that incorporate mechanism for limiting or arresting angular motion, such as a friction lock, may be used in conjunction with hinge 3 in lieu of a mechanical stop to permit the angle of the headrest 1 relative to baseboard 2 to be adjusted for the user's comfort. In the embodiments shown herein, a principal angle is defined by the substantially flat, planar surfaces of headrest 1 and baseboard 2 as shown in FIGS. 1-6. That is, if headrest 1 and baseboard 2 in certain embodiments are defined by a length, L; width, W; and thickness, T, then T is much less than L or W, and the principal angle is defined between the planes L×W defined in headrest 1 and baseboard 2. As shown in FIG. 4, when the portable head support is in use, the hinge 3 facilitates the adjustment of the principal angle, i.e. the angle between headrest 1 and baseboard 2 with hinge 3 providing a single degree of freedom for adjustment. However, it is also possible in certain embodiments for the angle between headrest 1 and baseboard 2 to be adjustable in more than one degree of freedom by selecting the appropriate hinge mechanism.

FIG. 4 shows the portable head support in use. In many desired embodiments, the portable head support is capable of fitting entirely within a carry-on item 5 while not in use. To use the portable head support, a user rests the carry on item 5 on their lap, and the portable head support is pulled up out of the carry-on item 5 such that all of headrest 1 is outside, while baseboard 2 remains inside. The angle between headrest 1 and baseboard 2 is then adjusted to the user's preference. The user can then rest their face on headrest 1 while their arms are wrapped around the carry-on item. It was found that this results in a comfortable sleeping position for those accustomed to sleeping in a prone position, i.e. "face down". Overall, the portable head support described herein results in a much more comfortable sleeping position when a traveler is confined to a sitting position, because the head is supported, and the user's torso is also supported somewhat by the carry-on item itself when the carry-on is held against the user's body by the user's arms.

Figure 7:
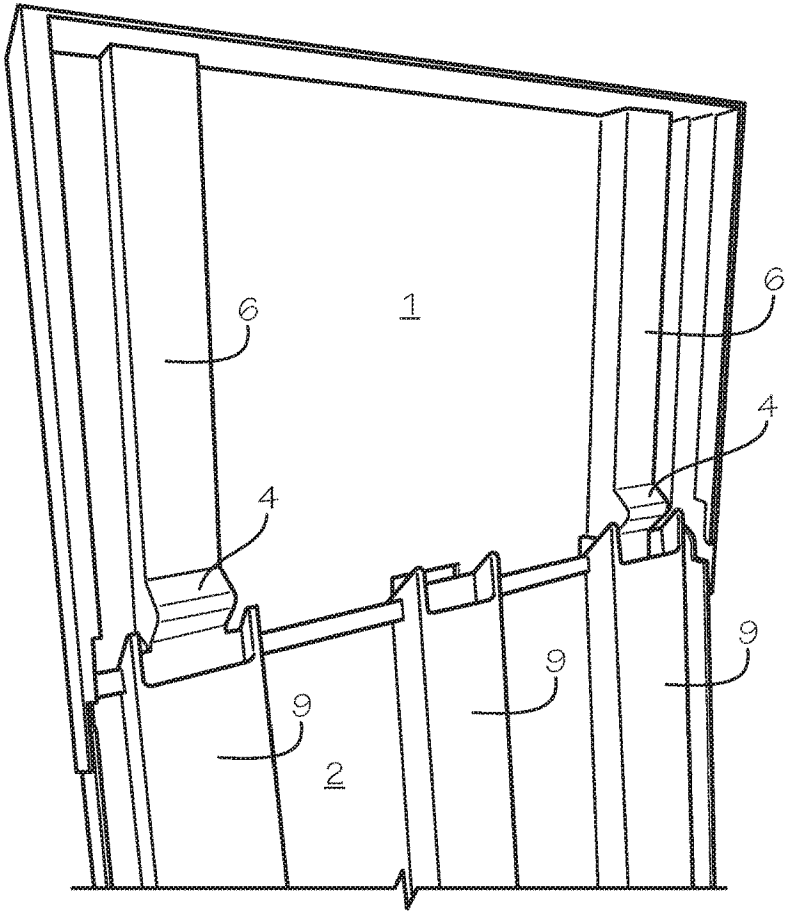
FIG. 7 is a rear view of an alternate embodiment of the invention.
Figure 10:
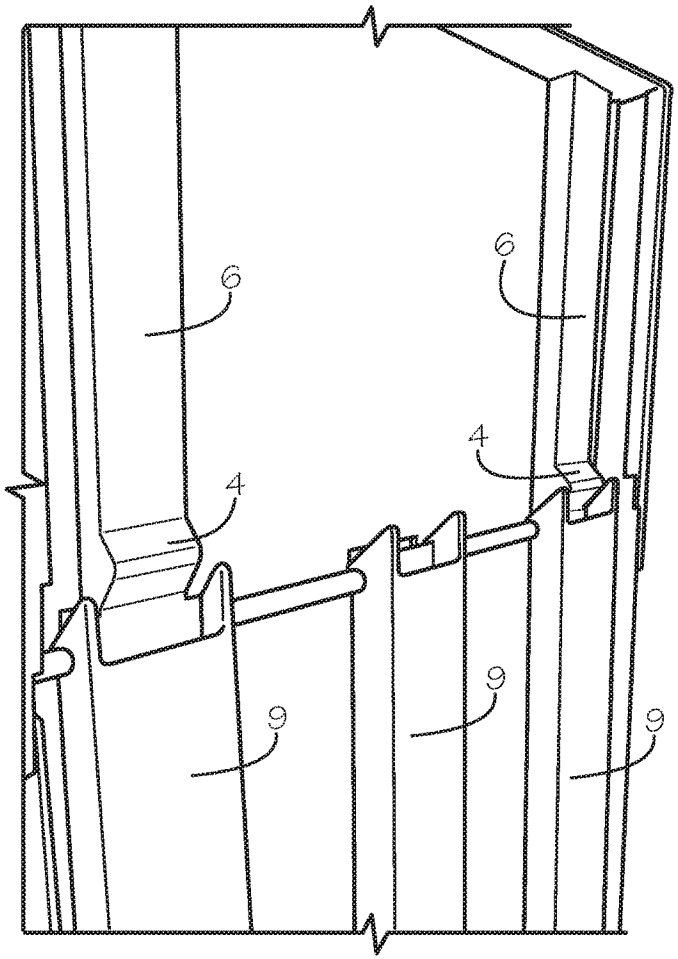
FIG. 10 is a rear view of an alternate embodiment of the invention in the fully-extended, unfolded position.
Figure 9:
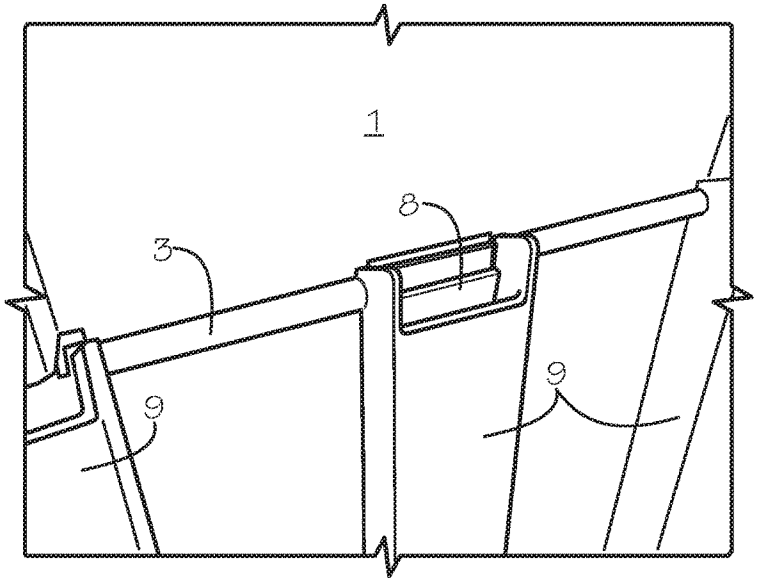
FIG. 9 is a rear view of an alternate embodiment showing a close-up of the hinge mechanism.
Figure 12:
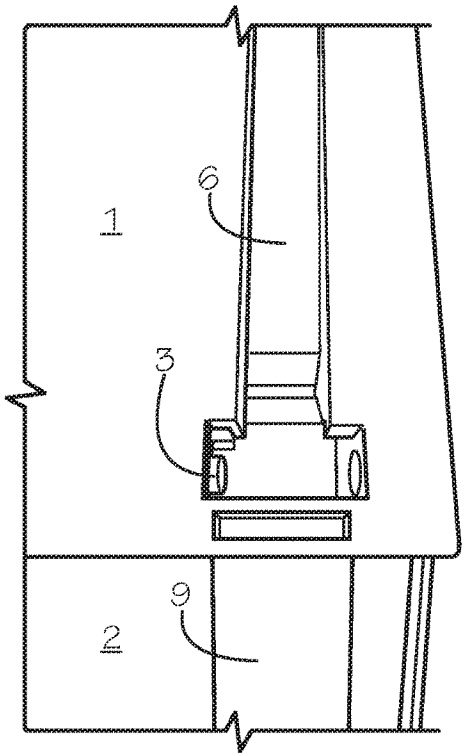
FIG. 12 is a front view of an alternate embodiment of the invention, showing a close-up view of the hinge mechanism.
Figure 11:
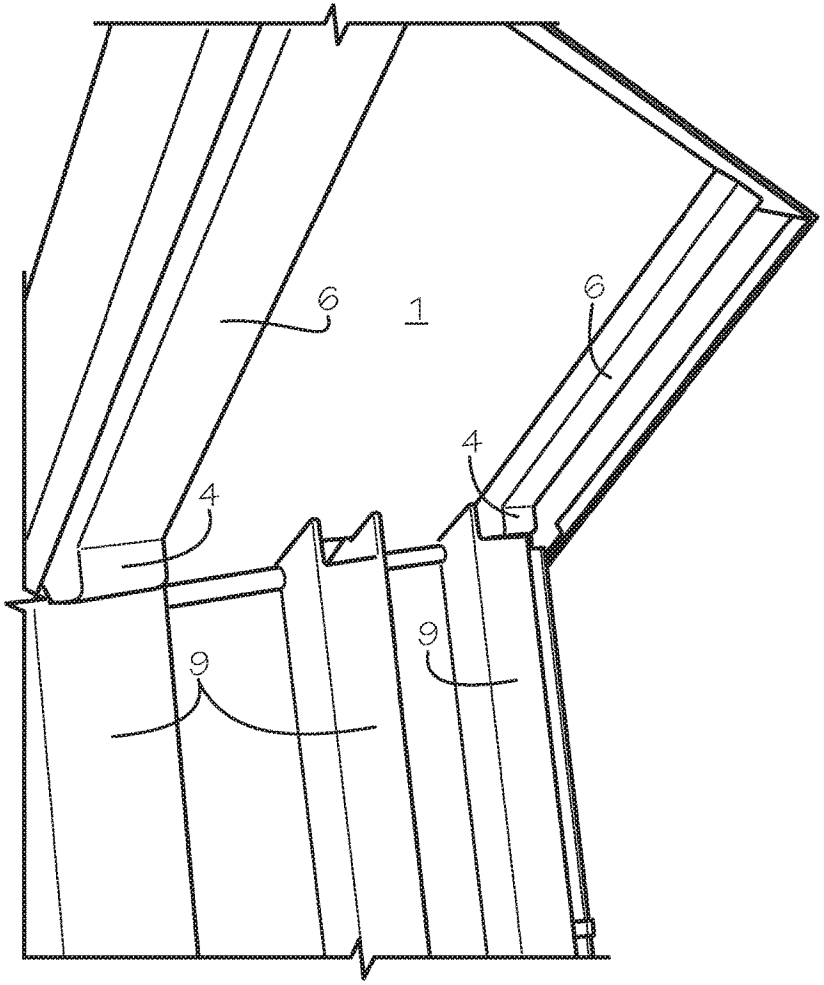
FIG. 11 is a rear view of an alternate embodiment of the invention in the fully-extended, folded position.

An alternate embodiment of the invention is shown in FIGS. 7 through 14. This embodiment is collapsible and therefore easier to fit into a carry-on item 5. As in the previously described embodiment, this embodiment features a headrest 1 that is attached to baseboard 2 at a hinge 3. However, in this embodiment, headrest 1 features rails 6, and baseboard 2 features channels 9, as shown in FIGS. 7-15. Rails 6 fit into channels 9, permitting headrest 1 to slide parallel to baseboard 2. In this embodiment, baseboard 2 has a hinge 3 shown in FIGS. 9 and 12 that permits headrest 1 to fold to a predetermined angle (i.e. principal angle described above) relative to baseboard 2 when headrest 1 is fully extended relative to baseboard 2. The angle is dictated by the shape of mechanical stops 4 shown in FIG. 7; in one embodiment, this predetermined angle is 40 degrees. Mechanical stops 4 are located at one end of rails 6 as shown in FIG. 7, and also facilitate the sliding action between rails 6 and channels 9. When headrest 1 is fully extended relative to baseboard 2 as down in FIG. 7, bracket 8 engages hinge 3 as shown in FIG. 9, and acts in part to prevent rails 6 of headrest 1 from sliding out of rails 9, i.e. to prevent headrest 1 and baseboard 2 from becoming separated. In this configuration, where headrest 1 is fully-extended relative to baseboard 2, there is a gap created between mechanical stops 4 and the end of channels 9 in baseboard 2 as shown in FIGS. 7 and 10. Headrest 1 can then be folded at an angle until mechanical stops 4 contact the ends of channels 9, as shown in FIG. 11.

The hinging mechanism between headrest 1 and baseboard 2 is shown in FIGS. 7, 9, 10, 11 and 12. Hinge 3 shown in FIGS. 9 and 12 engages the side of rails 9, permitting headrest 1 to both slide linearly relative to baseboard 2 when headrest 1 is in the unfolded position, and also allows headrest 1 to fold down to a predetermined angle relative to baseboard 2 when headrest 1 is fully extended relative to baseboard 2, as described above. One skilled in the art should readily appreciate that this configuration only permits headrest 1 to be folded at an angle relative to baseboard 2 the former is fully-extended relative to the latter, i.e. when bracket 8 engages hinge 3.

Figure 13:
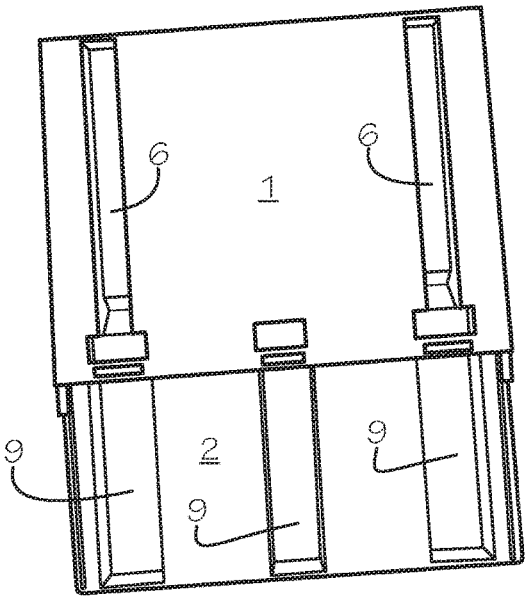
FIG. 13 is a front view of an alternate embodiment of the invention, showing a partially-collapsed configuration.
Figure 14:
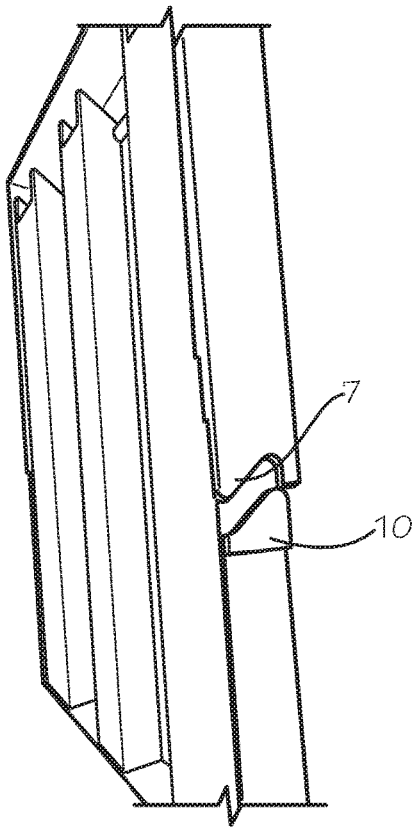
FIG. 14 is a side perspective view of an alternate embodiment of the invention.
Figure 15:
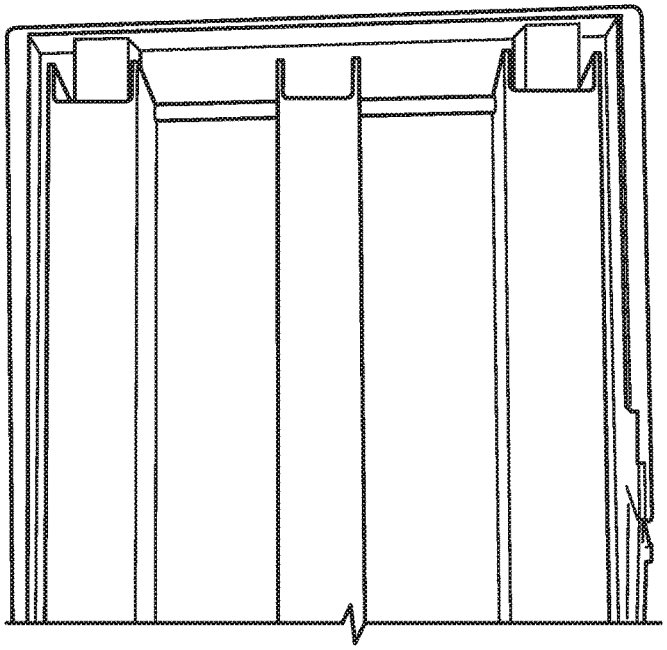
FIG. 15 is a rear view of an alternate embodiment of the invention in the fully-collapsed configuration.

In this embodiment, the overall device is more compact and easier to fit into a carry on item because headrest 1 is capable of sliding parallel to baseboard 2 by means of rails 6 in headrest 1 which slide in channels 9 in baseboard 2. The collapsible configurations of this embodiment are shown in FIGS. 13-15. As shown in FIG. 14, the fully collapsed configuration is defined by side stops 10 which are on each side of baseboard 2. Side stops 10 are engaged by notches 7 located on each side of headrest 1, as shown in FIG. 14. FIG. 15 is a rear view of the fully-collapsed configuration.

One skilled in the art will appreciate that this alternate embodiment can be comprised of a variety of materials, e.g. injection-moldable plastic, metal, fiberglass, or even wood, although injection-molded plastics are currently believed to be most cost-effective materials. It will also be readily appreciated that headrest 1 in this alternate embodiment can accommodate a variety of cushions as shown in FIG. 6, and can also feature openings to accommodate the user's face, as shown in FIG. 5.

Although the present invention has been described in detail with reference to certain embodiments, one skilled in the art will appreciate that the present invention can be practiced by other than the described embodiments, which have been presented for purposes of illustration and not of limitation. Therefore, the scope of the appended claims should not be limited to the description of the embodiments contained herein.

What is claimed is:

1. A device comprising:

a base insertable into the interior cavity of an article, so that said base receives supporting force from opposing sides of said cavity;

a headrest connected to said base in such a manner as permits said base and said headrest to exist in overlapping and non-overlapping configurations, wherein the principal angle is adjustable in said non-overlapping configuration;

wherein said device is capable of being removed from said cavity when not in use.

2. The device of claim 1, wherein said headrest and said base are slidably engaged in said overlapping configuration by a rail-channel structure, further comprising a hinge permitting the adjustment of said principal angle in said non-overlapping configuration.

3. The device of claim 1, wherein said headrest has at least one edge abutting a corresponding edge of said base in said non-overlapping configuration.

4. The device of claim 1, wherein said cavity is defined by the interior of an article.

5. The device of claim 4, wherein said article is a carry-on bag.

6. The device of claim 1, wherein said head support is detachable from said base.

7. A device comprising:

a substantially flat supporting member fitting inside a cavity;

a headrest disposed outside said cavity when said device is in use, said headrest engaged to said supporting member in such manner that said headrest and said supporting member can slidably translate such that at least one edge of said headrest overlaps said supporting member, and the principal angle is adjustable when said at least one edge does not overlap said supporting member;

wherein said cavity is defined by the interior of a portable article, and said device is either storable within said cavity, or capable of being completely removed from said cavity, when not in use.

8. A method of manufacturing a headrest device capable of being carried within a portable article, comprising:

fabricating a base insertable into the interior cavity of an article, such that said base can be removed from said portable article when not in use;

fabricating a headrest capable of accommodating a plurality of cushions and sized so that the combination of said headrest and said base are contained within said portable article; and attaching said headrest to said base in such a way that said base and said headrest can exist in overlapping and non-overlapping configurations; wherein the principal angle can be adjusted in said non-overlapping configuration.

9. The method of claim 8, wherein said headrest has at least one edge abutting a corresponding edge of said base in said non-overlapping configuration.

10. The method of claim 8, wherein said cavity is defined by the interior of an article.

11. The method of claim 10, wherein said article is a carry-on bag.

12. The method of claim 8, wherein said head support is detachable from said base.

* * * * *